US009957805B2

(12) United States Patent
Soni et al.

(10) Patent No.: US 9,957,805 B2
(45) Date of Patent: May 1, 2018

(54) TURBOMACHINE AND TURBINE BLADE THEREFOR

(71) Applicant: General Electric Company, Schenectady, NY (US)

(72) Inventors: Sumeet Soni, Karnataka (IN); Ross James Gustafson, York, SC (US); Rohit Chouhan, Karnataka (IN); Jason Adam Neville, Greenville, SC (US)

(73) Assignee: General Electric Company, Schenectady, NY (US)

( * ) Notice: Subject to any disclaimer, the term of this patent is extended or adjusted under 35 U.S.C. 154(b) by 307 days.

(21) Appl. No.: 14/973,894

(22) Filed: Dec. 18, 2015

(65) Prior Publication Data

US 2017/0175530 A1 Jun. 22, 2017

(51) Int. Cl.

| | |
|---|---|
| ***F01D 5/14*** | (2006.01) |
| ***F04D 29/32*** | (2006.01) |
| ***F01D 5/20*** | (2006.01) |

(52) U.S. Cl.

CPC ..... *F01D 5/141* (2013.01); *F01D 5/145* (2013.01); *F01D 5/20* (2013.01); *F04D 29/324* (2013.01); *F05D 2220/32* (2013.01); *F05D 2240/122* (2013.01); *F05D 2240/301* (2013.01); *F05D 2250/71* (2013.01); *F05D 2250/74* (2013.01)

(58) Field of Classification Search

CPC ..... F01D 5/141; F01D 9/04; F05D 2240/12; F05D 2240/123; F05D 2240/124; F05D 2240/128; F05D 2240/304; F05D 2250/74

See application file for complete search history.

(56) References Cited

U.S. PATENT DOCUMENTS

| | | | | |
|---|---|---|---|---|
| 5,326,221 A * | 7/1994 | Amyot | F01D 5/141 415/181 |
| 6,375,420 B1 * | 4/2002 | Tanuma | F01D 5/141 415/199.5 |
| 6,450,770 B1 | 9/2002 | Wang et al. | |
| 6,709,239 B2 * | 3/2004 | Chandraker | F01D 5/141 416/238 |
| 6,779,973 B2 * | 8/2004 | Ito | F01D 5/141 415/191 |

(Continued)

FOREIGN PATENT DOCUMENTS

WO 03/006798 A1 1/2003

OTHER PUBLICATIONS

International Search Report and Written Opinion issued in connection with related PCT Application No. PCT/PL2015/050069 on Aug. 18, 2016.

(Continued)

*Primary Examiner* — Ninh H Nguyen

(74) *Attorney, Agent, or Firm* — James W. Pemrick; Ernest G. Cusick; Frank A. Landgraff

(57) ABSTRACT

A blade has an airfoil, and the blade is configured for use with a turbomachine. The airfoil has a throat distribution measured at a narrowest region in a pathway between adjacent blades, at which adjacent blades extend across the pathway between opposing walls to aerodynamically interact with fluid flow. The airfoil defines the throat distribution, and the throat distribution reduces aerodynamic loss and improves aerodynamic loading on the airfoil. The airfoil has a linear trailing edge profile.

18 Claims, 7 Drawing Sheets

(56) References Cited

U.S. PATENT DOCUMENTS

| | | | | |
|---|---|---|---|---|
| 7,048,509 | B2 * | 5/2006 | Tominaga | F01D 5/14 416/223 A |
| 8,957,959 | B2 | 3/2015 | Stein et al. | |
| 8,998,577 | B2 | 4/2015 | Gustafson et al. | |
| 2013/0104550 | A1 | 5/2013 | Smith et al. | |

OTHER PUBLICATIONS

International Search Report and Written Opinion issued in connection with related PCT Application No. PCT/PL2015/050070 on Aug. 18, 2016.

* cited by examiner

TURBOMACHINE AND TURBINE BLADE THEREFOR

BACKGROUND OF THE INVENTION

The subject matter disclosed herein relates to turbomachines, and more particularly to, a blade in a turbine.

A turbomachine, such as a gas turbine, may include a compressor, a combustor, and a turbine. Air is compressed in the compressor. The compressed air is fed into the combustor. The combustor combines fuel with the compressed air, and then ignites the gas/fuel mixture. The high temperature and high energy exhaust fluids are then fed to the turbine, where the energy of the fluids is converted to mechanical energy. The turbine includes a plurality of nozzle stages and blade stages. The nozzles are stationary components, and the blades rotate about a rotor.

BRIEF DESCRIPTION OF THE INVENTION

Certain embodiments commensurate in scope with the originally claimed subject matter are summarized below. These embodiments are not intended to limit the scope of the claimed subject matter, but rather these embodiments are intended only to provide a brief summary of possible forms of the claimed subject matter. Indeed, the claimed subject matter may encompass a variety of forms that may be similar to or different from the aspects/embodiments set forth below.

In one aspect, a blade has an airfoil, and the blade is configured for use with a turbomachine. The airfoil has a throat distribution measured at a narrowest region in a pathway between adjacent blades, at which adjacent blades extend across the pathway between opposing walls to aerodynamically interact with fluid flow. The airfoil defines the throat distribution, and the throat distribution reduces aerodynamic loss and improves aerodynamic loading on the airfoil. The airfoil has a linear trailing edge profile.

In another aspect, an article of manufacture comprises an airfoil. The airfoil has a throat distribution measured at a narrowest region in a pathway between adjacent airfoils. The airfoil defines the throat distribution, and the throat distribution reduces aerodynamic loss and improves aerodynamic loading on the airfoil. The airfoil has a linear trailing edge profile, and the trailing edge profile is offset by about 1.8 degrees in an upstream axial direction and by about 1.4 degrees in a circumferential direction.

In yet another aspect, a turbomachine has a plurality of blades, and each blade has an airfoil. The turbomachine includes opposing walls that define a pathway into which a fluid flow is receivable to flow through the pathway. A throat distribution is measured at a narrowest region in the pathway between adjacent blades, at which adjacent blades extend across the pathway between the opposing walls to aerodynamically interact with the fluid flow. The airfoil defines the throat distribution, and the throat distribution reduces aerodynamic loss and improves aerodynamic loading on the airfoil. The airfoil has a linear trailing edge profile.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION OF THE INVENTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," and "the" are intended to mean that there are one or more of the elements. The terms "comprising," "including," and "having" are intended to be inclusive and mean that there may be additional elements other than the listed elements.

Figure 1:
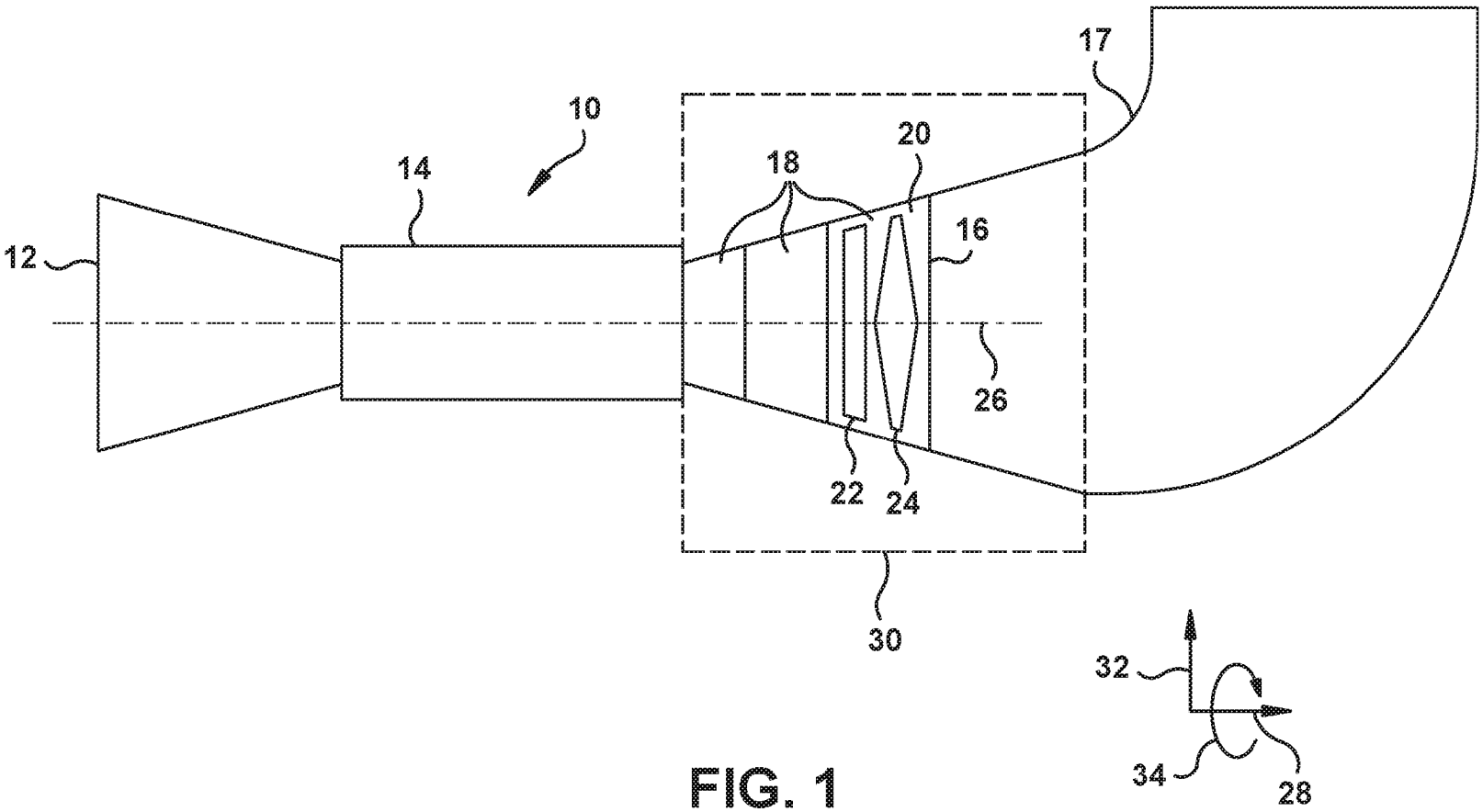
FIG. 1 is a diagram of a turbomachine in accordance with aspects of the present disclosure.

FIG. 1 is a diagram of one embodiment of a turbomachine 10 (e.g., a gas turbine and/or a compressor). The turbomachine 10 shown in FIG. 1 includes a compressor 12, a combustor 14, a turbine 16, and a diffuser 17. Air, or some other gas, is compressed in the compressor 12, fed into the combustor 14 and mixed with fuel, and then combusted. The exhaust fluids are fed to the turbine 16 where the energy from the exhaust fluids is converted to mechanical energy. The turbine 16 includes a plurality of stages 18, including an individual stage 20. Each stage 18, includes a rotor (i.e., a rotating shaft) with an annular array of axially aligned blades, which rotates about a rotational axis 26, and a stator with an annular array of nozzles. Accordingly, the stage 20 may include a nozzle stage 22 and a blade stage 24. For clarity, FIG. 1 includes a coordinate system including an axial direction 28, a radial direction 32, and a circumferential direction 34. Additionally, a radial plane 30 is shown. The radial plane 30 extends in the axial direction 28 (along the rotational axis 26) in one direction, and then extends outward in the radial direction 32.

Figure 2:
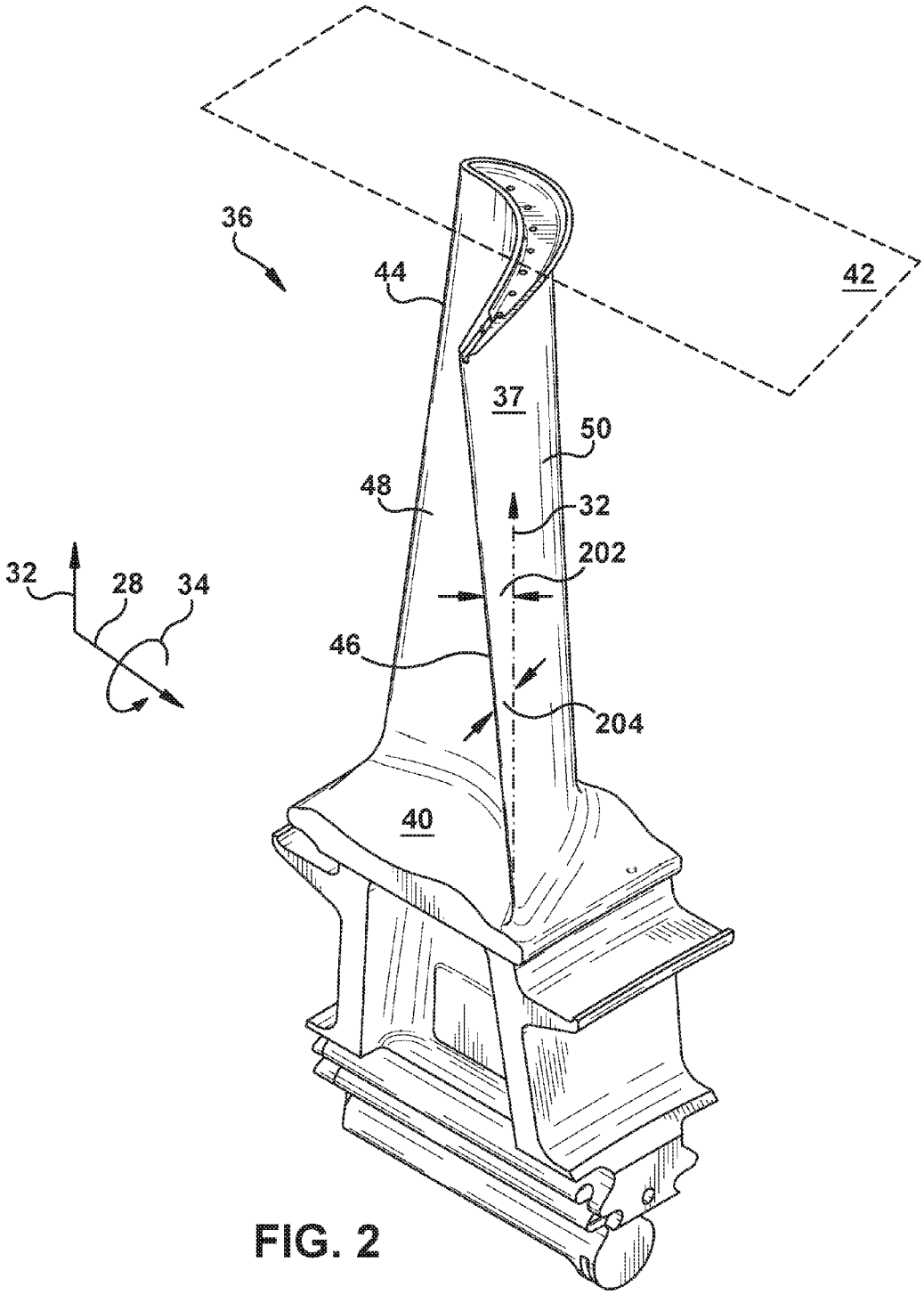
FIG. 2 is a perspective view of a blade in accordance with aspects of the present disclosure.

FIG. 2 is a perspective view of a blade 36. The blade may also be described as an article of manufacture. The blades 36 in the stage 20 extend in a radial direction 32 between a first wall (or platform) 40 and a second wall 42. First wall 40 is opposed to second wall 42, and both walls define a pathway into which a fluid flow is receivable. The blades 36 are disposed circumferentially 34 about a hub. Each blade 36 has an airfoil 37, and the airfoil 37 is configured to aerodynamically interact with the exhaust fluids from the combustor 14 as the exhaust fluids flow generally downstream through the turbine 16 in the axial direction 28. Each blade 36 has a leading edge 44, a trailing edge 46 disposed downstream, in the axial direction 28, of the leading edge 44, a pressure side 48, and a suction side 50. The pressure side 48 extends in the axial direction 28 between the leading edge 44 and the trailing edge 46, and in the radial direction 32 between the first wall 40 and towards the second wall 42. The suction side 50 extends in the axial direction 28 between the leading edge 44 and the trailing edge 46, and in the radial direction 32 between the first wall 40 and the second wall 42, opposite the pressure side 48. The blades 36 in the stage 20 are configured such that the pressure side 48 of one blade 36 faces the suction side 50 of an adjacent blade 36.

The airfoil 37 has a linear trailing edge 46 profile, where a generally straight line connects an upper (radially outward) portion of the trailing edge to a lower (radially inner) portion of the trailing edge. The trailing edge profile is offset with respect to an axial plane, and the trailing edge is canted forward (axially upstream) by about 1.8 degrees (see 202) with respect to the bottom (or radially lower) portion of the trailing edge. For example, the trailing edge 46 does not extend exactly radially outward in an axial plane, but rather is angled axially upstream by about 1.8 degrees. The 1.8 degree value is only one example, and any suitable axial forward cant may be used in the desired application. The trailing edge is also offset in the circumferential direction by about 1.4 degrees (see 204). The circumferential direction is in an axial plane that extends 360 degrees around the rotor. A zero offset would be a radial line, such as radial axis 32. In contrast, the trailing edge is offset from the radial axis 32 by about 1.4 degrees in a direction indicated by arrow 34 in FIG. 2. For example, when looking from the downstream side (near trailing edge 46) of the blade 36 towards the upstream side (near leading edge 44) of the blade, the circumferential offset is in the left or counter-clockwise direction. The trailing edge profile offset in the axial and circumferential directions improves the blade's resistance to mechanical stress, and reduces secondary flow losses as well as radially redistributing flow to improve overall performance. As the exhaust fluids flow toward and through the passage between blades 36, the exhaust fluids aerodynamically interact with the blades 36 such that the exhaust fluids flow with an angular momentum relative to the axial direction 28. A blade stage 24 populated with blades 36 having the specific throat distribution and trailing edge offset is configured to exhibit reduced aerodynamic loss and improved aerodynamic loading, and may result in improved machine efficiency and part longevity.

Figure 3:
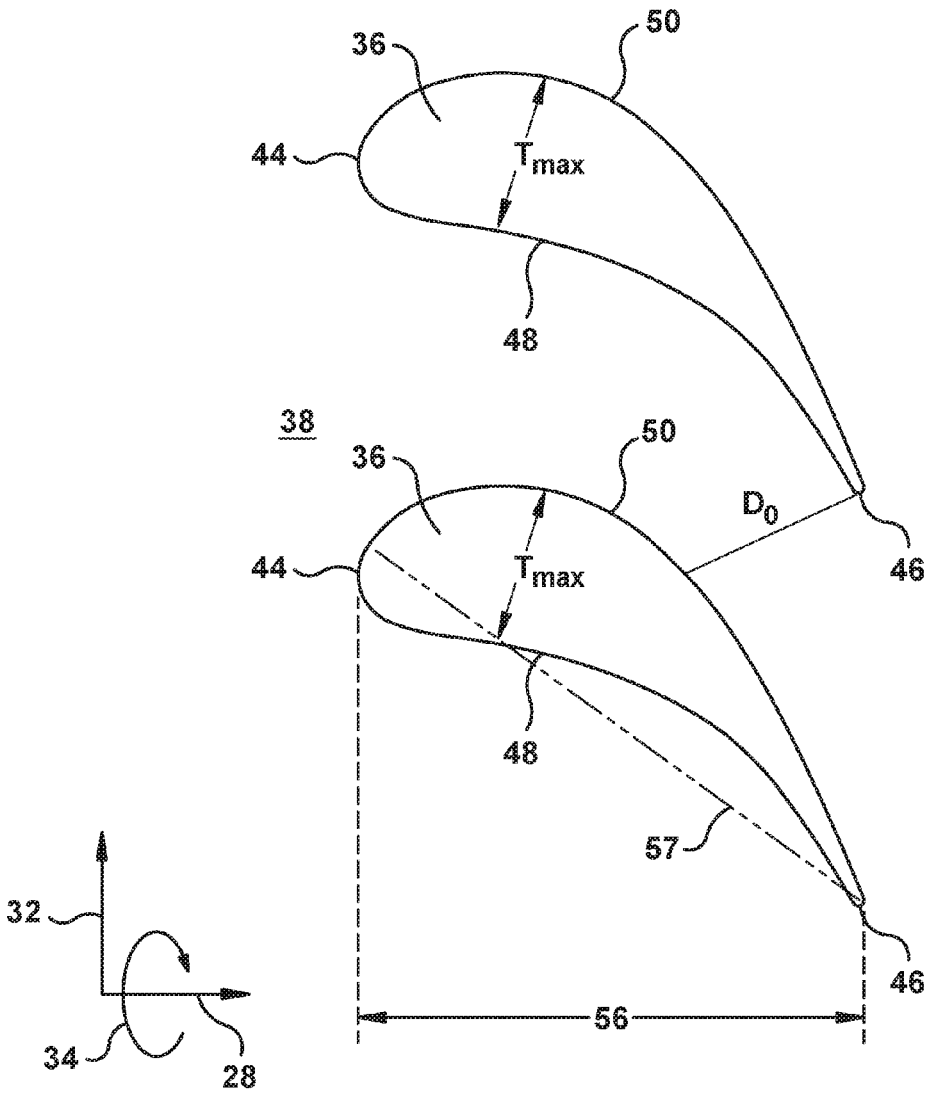
FIG. 3 is a top view of two adjacent blades in accordance with aspects of the present disclosure.

FIG. 3 is a top view of two adjacent blades 36. Note that the suction side 50 of the bottom blade 36 faces the pressure side 48 of the top blade 36. The axial chord 56 is the dimension of the blade 36 in the axial direction 28. The chord 57 is the distance between the leading edge and trailing edge of the airfoil. The passage 38 between two adjacent blades 36 of a stage 18 defines a throat distribution $D_o$, measured at the narrowest region of the passage 38 between adjacent blades 36. Fluid flows through the passage 38 in the axial direction 28. This throat distribution $D_o$ across the span from the first wall 40 to the second wall 42 will be discussed in more detail in regard to FIG. 4. The maximum thickness of each blade 36 at a given percent span is shown as Tmax. The Tmax distribution across the height of the blade 36 will be discussed in more detail in regard to FIG. 4.

Figure 4:
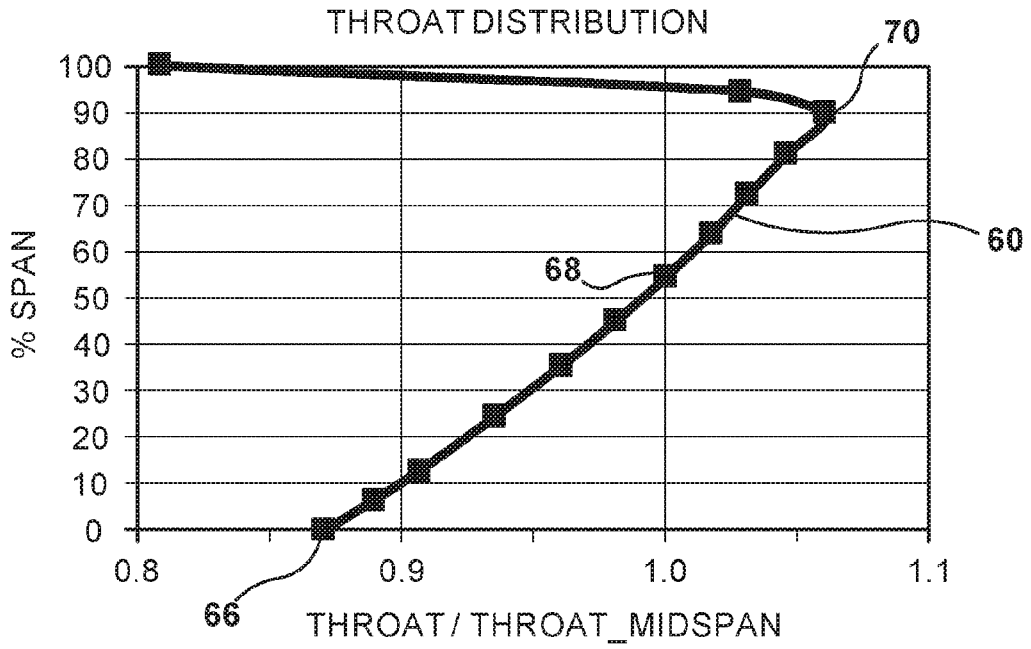
FIG. 4 is a plot of throat distribution in accordance with aspects of the present disclosure.

FIG. 4 is a plot of throat distribution $D_o$ defined by adjacent blades 36 and shown as curve 60. The vertical axis represents the percent span between the first annular wall 40 and the second annular wall 42 or opposing end of airfoil 37 in the radial direction 32. That is, 0% span generally represents the first annular wall 40 and 100% span represents the opposing end of airfoil 37, and any point between 0% and 100% corresponds to a percent distance between the radially inner and radially outer portions of airfoil 37, in the radial direction 32 along the height of the airfoil. The horizontal axis represents $D_o$ (Throat), the shortest distance between two adjacent blades 36 at a given percent span, divided by the $D_{o_MidSpan}$ (Throat MidSpan), which is the $D_o$ at about 50% to about 55% span. Dividing $D_o$ by the $D_{o_MidSpan}$ makes the plot non-dimensional, so the curve 60 remains the same as the blade stage 24 is scaled up or down for different applications. One could make a similar plot for a single size of turbine in which the horizontal axis is just $D_o$.

As can be seen in FIG. 4, the throat distribution, as defined by a trailing edge of the blade, extends generally linearly from a throat/throat_mid-span value of about 87% at about 0% span (point 66) to a throat/throat_mid-span value of about 106% at about 90% span (point 70), and a throat/throat mid-span value of about 103% at about 95% span. The span at 0% is at a radially inner portion of the airfoil and the span at 100% is at a radially outer portion of the airfoil. The throat/throat mid-span value is 100% at about 50% to 55% span (point 68). The throat distribution shown in FIG. 4 may help to improve performance in two ways. First, the throat distribution helps to produce desirable exit flow profiles. Second, the throat distribution shown in FIG. 4 may help to manipulate secondary flows (e.g., flows transverse to the main flow direction) and/or purge flows near the first annular wall 40 (e.g., the hub). Table 1 lists the throat distribution of the airfoil 37 along multiple span locations. FIG. 4 is a graphical illustration of the throat distribution and the values listed in Table 1. It is to be understood that the throat distribution and the values in Table 1 may be used within a tolerance of +/−10%.

TABLE 1

| % Span | Throat/Throat_MidSpan |
|---|---|
| 100 | 0.809 |
| 95 | 1.028 |
| 90 | 1.060 |
| 81 | 1.045 |
| 72 | 1.031 |
| 64 | 1.017 |
| 55 | 1.000 |
| 45 | 0.981 |
| 35 | 0.960 |
| 25 | 0.936 |
| 13 | 0.907 |
| 7 | 0.890 |
| 0 | 0.871 |

Figure 5:
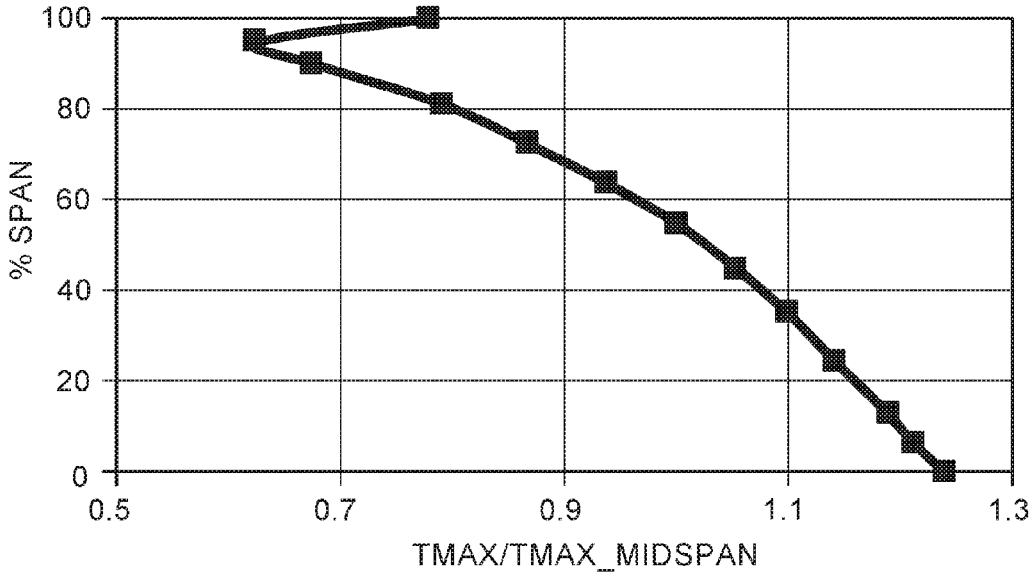
FIG. 5 is a plot of maximum thickness distribution in accordance with aspects of the present disclosure.

FIG. 5 is a plot of the thickness distribution Tmax/Tmax_Midspan, as defined by a thickness of the blade's airfoil 37. The vertical axis represents the percent span between the first annular wall 40 and opposing end of airfoil 37 in the radial direction 32. The horizontal axis represents the Tmax divided by Tmax_Midspan value. Tmax is the maximum thickness of the airfoil at a given span, and Tmax_Midspan is the maximum thickness of the airfoil at mid-span (e.g., about 50% to 55% span). Dividing Tmax by Tmax_Midspan makes the plot non-dimensional, so the curve remains the same as the blade stage 24 is scaled up or down for different applications. Referring to Table 2, a mid-span value of 53% has a Tmax/Tmax_Midspan value of 1, because at this span Tmax is equal to Tmax_Midspan.

TABLE 2

| % Span | Tmax/Tmax_MidSpan |
|---|---|
| 100 | 0.78 |
| 95 | 0.63 |
| 90 | 0.68 |
| 81 | 0.79 |
| 72 | 0.87 |
| 64 | 0.94 |
| 55 | 1.00 |
| 45 | 1.05 |
| 35 | 1.10 |
| 25 | 1.14 |
| 13 | 1.19 |
| 7 | 1.21 |
| 0 | 1.24 |

Figure 6:
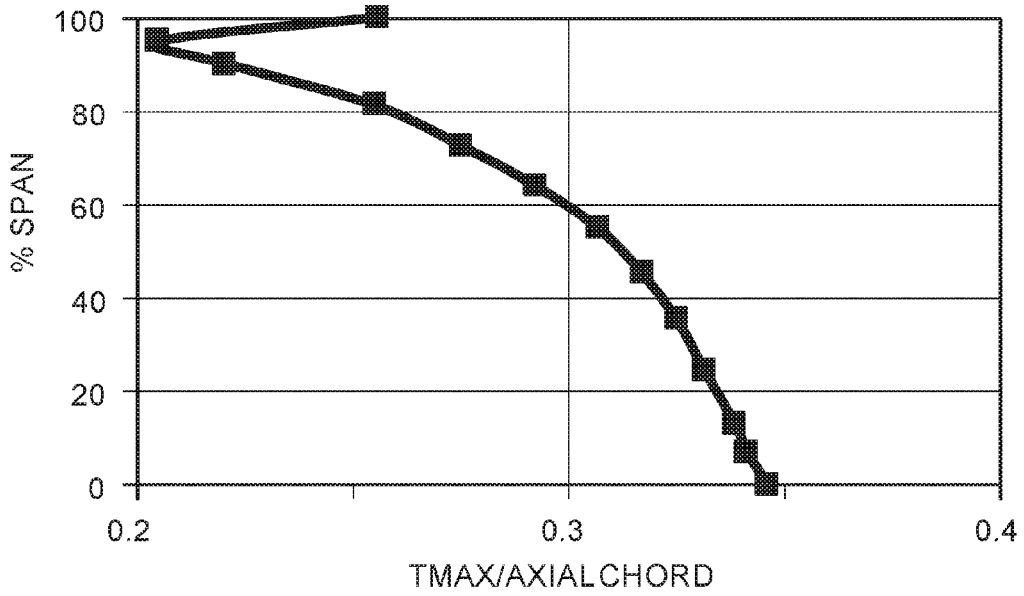
FIG. 6 is a plot of maximum thickness divided by axial chord distribution in accordance with aspects of the present disclosure.

FIG. 6 is a plot of the airfoil thickness (Tmax) divided by the airfoil's axial chord along various values of span. The vertical axis represents the percent span between the first annular wall 40 and opposing end of airfoil 37 in the radial direction 32. The horizontal axis represents the Tmax divided by axial chord value. Dividing the airfoil thickness by the axial chord makes the plot non-dimensional, so the curve remains the same as the blade stage 24 is scaled up or down for different applications. A blade design with the Tmax distribution shown in FIGS. 5 and 6 may help to tune the resonant frequency of the blade in order to avoid crossings with drivers. Accordingly, a blade 36 design with the Tmax distribution shown in FIGS. 5 and 6 may increase the operational lifespan of the blade 36. Table 3 lists the Tmax/Axial Chord value for various span values.

TABLE 3

| % Span | Tmax/Chord |
|---|---|
| 100 | 0.256 |
| 95 | 0.206 |
| 90 | 0.221 |
| 81 | 0.255 |
| 72 | 0.275 |
| 64 | 0.293 |
| 55 | 0.307 |
| 45 | 0.317 |
| 35 | 0.325 |
| 25 | 0.331 |
| 13 | 0.338 |
| 7 | 0.341 |
| 0 | 0.346 |

Figure 7:
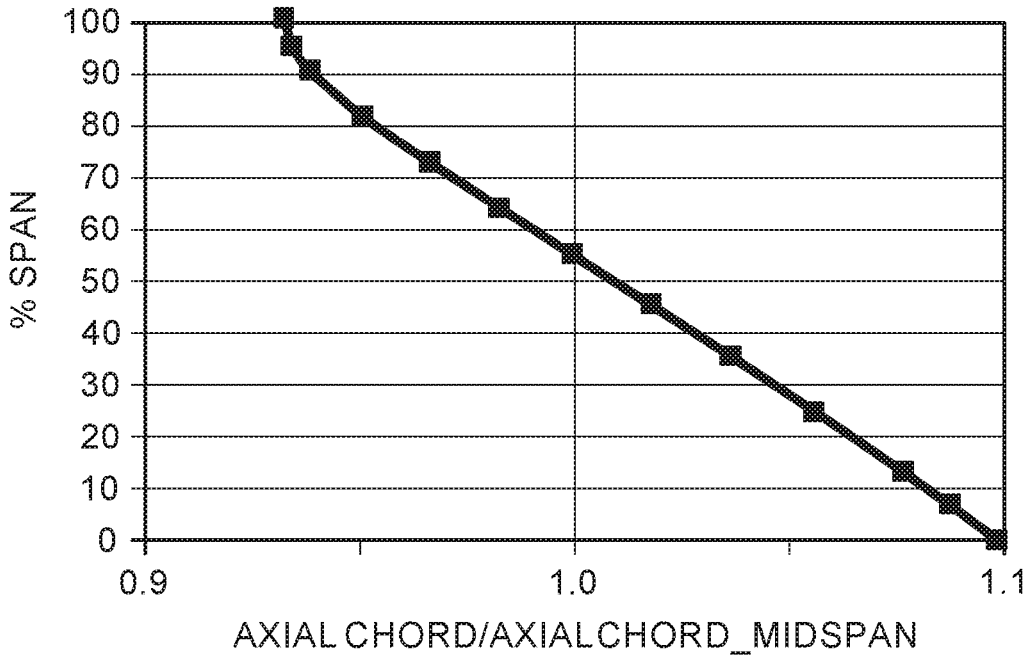
FIG. 7 is a plot of axial chord divided by axial chord at mid-span in accordance with aspects of the present disclosure.

FIG. 7 is a plot of the airfoil's axial chord divided by the axial chord value at mid-span along various values of span. The vertical axis represents the percent span between the first annular wall 40 and opposing end of airfoil 37 in the radial direction 32. The horizontal axis represents the axial chord divided by axial chord at mid-span value. Referring to Table 4, a mid-span value of 55% has a Axial Chord/Axial Chord_MidSpan value of 1, because at this span axial chord is equal to axial chord at the mid-span location. Dividing the axial chord by the axial chord at mid-span makes the plot non-dimensional, so the curve remains the same as the blade stage 24 is scaled up or down for different applications. Table 4 lists the values for the airfoil's axial chord divided by the axial chord value at mid-span along various values of span.

TABLE 4

| % Span | Axial Chord/Axial Chord_MidSpan |
|---|---|
| 100 | 0.933 |
| 95 | 0.935 |
| 90 | 0.939 |
| 81 | 0.951 |
| 72 | 0.967 |
| 64 | 0.983 |
| 55 | 1.000 |
| 45 | 1.018 |
| 35 | 1.037 |
| 25 | 1.056 |
| 13 | 1.077 |
| 7 | 1.087 |
| 0 | 1.098 |

A blade design with the axial chord distribution shown in FIG. 7 may help to tune the resonant frequency of the blade in order to avoid crossings with drivers. For example, a blade with a linear design may have a resonant frequency of 400 Hz, whereas the blade 36 with an increased thickness around certain spans may have a resonant frequency of 450 Hz. If the resonant frequency of the blade is not carefully tuned to avoid crosses with the drivers, operation may result in undue stress on the blade 36 and possible structural failure. Accordingly, a blade 36 design with the axial chord distribution shown in FIG. 7 may increase the operational lifespan of the blade 36.

Technical effects of the disclosed embodiments include improvement to the performance of the turbine in a number of different ways. The blade 36 design and the throat distribution shown in FIG. 4 may help to manipulate secondary flows (i.e., flows transverse to the main flow direction) and/or purge flows near the hub (e.g., the first annular wall 40). The axial chord and thickness distribution help to tune the natural frequency of blade 36. If the resonant frequency of the blade is not carefully tuned to avoid crosses with the drivers, operation may result in undue stress on the blade 36 and possible structural failure. Accordingly, a blade 36 design with the increased thickness at specific span locations may increase the operational lifespan of the blade 36.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A blade having an airfoil, the blade configured for use with a turbomachine, the airfoil comprising:

a throat distribution measured at a narrowest region in a pathway between adjacent blades, at which adjacent blades extend across the pathway between opposing walls to aerodynamically interact with a fluid flow; and the airfoil defining the throat distribution, the throat distribution reducing aerodynamic loss and improving aerodynamic loading on the airfoil, and the airfoil having a linear trailing edge profile, the trailing edge having a profile offset in both an axial direction and a circumferential direction.

2. The blade of claim 1, the trailing edge offset by about 1.8 degrees upstream in the axial direction.

3. The blade of claim 2, the trailing edge offset by about 1.4 degrees in the circumferential direction.

4. The blade of claim 3, the throat distribution, as defined by a trailing edge of the blade, extending generally curvilinearly from a throat/throat mid-span value of about 87% at about 0% span to a throat/throat mid-span value of about 106% at about 90% span, a throat/throat mid-span value of about 103% at about 95% span, and a throat/throat mid-span value of about 81% at about 100% span; and wherein the span at 0% is at a radially inner portion of the airfoil and a span at 100% is at a radially outer portion of the airfoil, and the throat/throat mid-span value is 100% at about 55% span.

5. The blade of claim 3, the throat distribution defined by values set forth in Table 1 within a tolerance of +/−10%.

6. The blade of claim 5, the airfoil having a thickness distribution (Tmax/Tmax_Midspan) as defined by values set forth in Table 2.

7. The blade of claim 6, the airfoil having a non-dimensional thickness divided by axial chord distribution according to values set forth in Table 3.

8. The blade of claim 7, the airfoil having a non-dimensional axial chord divided by axial chord at mid-span distribution according to values set forth in Table 4.

9. An article of manufacture, the article of manufacture comprising an airfoil, the airfoil comprising:

a throat distribution measured at a narrowest region in a pathway between adjacent airfoils; and the airfoil defining the throat distribution, the throat distribution reducing aerodynamic loss and improving aerodynamic loading on the airfoil, and the airfoil having a linear trailing edge profile, the trailing edge profile offset by about 1.8 degrees in an upstream axial direction and by about 1.4 degrees in a circumferential direction.

10. The article of manufacture of claim 9, the throat distribution defined by values set forth in Table 1 within a tolerance of +/−10%, and the airfoil having a thickness distribution (Tmax/Tmax_Midspan) as defined by values set forth in Table 2.

11. The article of manufacture of claim 10, the airfoil having a non-dimensional thickness divided by axial chord distribution according to values set forth in Table 3, and a non-dimensional axial chord divided by axial chord at mid-span distribution according to values set forth in Table 4.

12. A turbomachine comprising a plurality of blades, each blade comprising an airfoil, the turbomachine comprising:

opposing walls defining a pathway into which a fluid flow is receivable to flow through the pathway, a throat distribution is measured at a narrowest region in the pathway between adjacent blades, at which adjacent blades extend across the pathway between the opposing walls to aerodynamically interact with the fluid flow; and the airfoil defining the throat distribution, the throat distribution reducing aerodynamic loss and improving aerodynamic loading on the airfoil, and the airfoil having a linear trailing edge profile, the trailing edge having a profile offset in both an axial direction and a circumferential direction.

13. The turbomachine of claim 12, the trailing edge offset by about 1.8 degrees upstream in the axial direction, the trailing edge offset by about 1.4 degrees in the circumferential direction.

14. The turbomachine of claim 13, the throat distribution, as defined by a trailing edge of the blade, extending generally curvilinearly from a throat/throat mid-span value of about 87% at about 0% span to a throat/throat mid-span value of about 106% at about 90% span, a throat/throat mid-span value of about 103% at about 95% span, and a throat/throat mid-span value of about 81% at about 100% span; and wherein the span at 0% is at a radially inner portion of the airfoil and a span at 100% is at a radially outer portion of the airfoil, and the throat/throat mid-span value is 100% at about 55% span.

15. The turbomachine of claim 13, the throat distribution defined by values set forth in Table 1 within a tolerance of +/−10%.

16. The turbomachine of claim 13, the airfoil having a thickness distribution (Tmax/Tmax_Midspan) as defined by values set forth in Table 2.

17. The turbomachine of claim 13, the airfoil having a non-dimensional thickness divided by axial chord distribution according to values set forth in Table 3.

18. The turbomachine of claim 13, the airfoil having a non-dimensional axial chord divided by axial chord at mid-span distribution according to values set forth in Table 4.

* * * * *